United States Patent [19]

Gargini et al.

[11] Patent Number: 4,612,519

[45] Date of Patent: Sep. 16, 1986

[54] SWITCH ASSEMBLY AND CIRCUIT

[75] Inventors: Eric J. Gargini, West Drayton; Gideon Kalanit, New Malden, both of England

[73] Assignee: Communications Patents Limited, London, England

[21] Appl. No.: 690,520

[22] Filed: Jan. 11, 1985

[30] Foreign Application Priority Data

Jan. 14, 1984 [GB] United Kingdom ..... 8401002

[51] Int. Cl.[4] ..... H01P 1/15

[52] U.S. Cl. ..... 333/103; 333/104; 333/119; 333/262; 333/246; 361/412

[58] Field of Search ..... 333/103, 104, 262, 101; 307/239, 241, 242; 361/395, 412, 415

[56] References Cited

U.S. PATENT DOCUMENTS 3,833,866 9/1974 Boutelant ..... 333/104
4,267,538 5/1981 Assal et al. ..... 333/262
4,356,461 10/1982 Acoraci ..... 333/116
4,525,689 6/1985 Wagner et al. ..... 333/104
4,527,136 7/1985 Kamiya ..... 333/103

*Primary Examiner*—Paul Gensler
*Attorney, Agent, or Firm*—Laurence R. Brown

[57] ABSTRACT

A switch circuit and assembly for selectively connecting any one of a series of inputs each carrying a number of VHF signals to any one of a series of outputs. Each input is applied to a respective input board and each output to a respective output board, the input boards being arranged in parallel and generally perpendicular to the output boards. Connections are made between any one input board and each output board by respective pairs of interengaging terminals arranged adjacent the board edges. Isolating plates are interleaved with the boards, the plates located between the input boards extending into the spaces between the output boards, and the plates located between the output boards extending into the spaces between the input board, thereby defining a series of four sided isolating structures around each interengaging pair of terminals.

9 Claims, 15 Drawing Figures

SWITCH ASSEMBLY AND CIRCUIT

The present invention relates to a switch assembly and circuit, and in particular to a switch assembly and circuit for use in a cable television distribution network.

Cable television distribution networks are known in which a plurality of signals are transmitted from a head end to a switching centre. Located within the switching centre is a series of switch units remotely controlled by subscribers, each subscriber being able to control a respective switch unit so as to select any one of the available signals for transmission to the subscribers receiver. Networks of this type are generally known as star networks, and may use either conductors or optic fibres or combinations of the two to transmit signals.

British Pat. Nos. 2 063 026 and 2 121 656, respectively U.S. Pat. Nos. 4,302,771 and 4,538,174, describe networks in which signals are transmitted from the head end to switching centres on six trunk transmission lines, each trunk transmission line carrying five VHF television signals which are distinguished from each other by frequency. Thus the signals on each trunk line can occupy frequency channels having luminance frequencies of for example 69.2, 75.2, 93.2, 123.2 and 135.2 MHz respectively. At the switching centres, one of the thirty available signals is selected by firstly selecting the packet of five signals on one trunk transmission line which includes the desired one signal, and then by selecting from the five signals on that transmission line the desired one signal by converting the desired signal to the frequency appropriate to the particular subscribers receiver.

With the above networks, in the first selection stage it is necessary to provide a switch which can connect any one of six inputs to a single output dedicated to a particular subscriber. The selected input is a VHF signal occupying a wide range of frequencies so that careful switch design is required if acceptable level of crosstalk and signal isolation are to be achieved.

British Patent Specification No. 1 509 713 (U.S. Pat. No. 4,058,770) describes the electrical characteristics of an HF switch which provides good HF signal isolation, thereby preventing signals leaking through nominally "off" switches. It will however be appreciated that the switches must be carefully screened to avoid crosstalk due to radiated signals. This is not a major problem at HF, but it is at VHF. In practice, if one assumes that the six VHF inputs and one VHF output to a subscriber's switch unit are all mounted on one board, and that for a group of say six subscribers there are six such boards each connected to the six trunk transmission lines, that is a total of thirty six inputs each carrying five VHF signals, it is very difficult to provide the degree of screening required. Furthermore, it is difficult to maintain the impedance presented by the switch unit to a particular VHF signal input or VHF signal output constant regardless of the selection made.

It is an object of the present invention to provide a switch assembly and circuit which provides good protection against crosstalk between a plurality of VHF inputs and outputs and good impedance characteristics.

According to the present invention, there is provided a switch assembly for connecting any one of a plurality of inputs each carrying a plurality of frequency distinguished signals to any one of a plurality of outputs, comprising an input board in respect of each input and an output board in respect of each output, the input boards being arranged in parallel and each supporting a solid state switch in respect of each output board, each input board solid state switch being connected between the input to the board and a respective terminal located adjacent the board edge, the output boards being arranged in parallel so as to be substantially perpendicular to the input boards and each supporting a solid state switch in respect of each input board, each output board solid state switch being connected between the output of the board and a respective terminal located adjacent the board edge, and each output board terminal engaging a respective input board terminal so that the terminals supported by any one output board engage terminals supported by respective ones of the input boards, wherein the adjacent pairs of parallel boards are isolated from each other by electrically conducting isolating plates interleaved with and extending parallel to the boards, the isolating plates comprising a first group located between the input boards and extending into the spaces between the output boards, and a second group located between the output boards and extending into the spaces between the input boards, whereby a series of four sided isolating structures are formed within each of which the terminals of a respective pair of interengaging terminals are located.

The invention also provides a circuit for connecting an input carrying a plurality of frequency distinguished signals to an output, comprising a first input diode connected in series with a second output diode between a tapping of an input transformer and the output, the transformer winding being connected between the signal input and ground, a first resistor connected between and in series with the first and second diodes, a control input connected to the tapping of the input transformer by a second resistor in series with a third diode, a fourth diode connected between ground and a point between the first and second diodes, and means for controlling the polarity of the control input relative to ground, wherein the output has a DC bias to ground, and the polarities of the diodes are such that the application of a potential of one polarity to the control input causes the first and second diodes to turn on and the third and fourth diodes to turn off, and the application of a potential of the opposite polarity to the control input causes the first and second diodes to turn off and the third and fourth diodes to turn on, the total impedance presented to the tap by the switch when the switch is off being the sum of the impedances of the second resistor and the third diode, and the total impedance presented to the tap by the switch when the switch is on being the sum of the impedances of the first resistor, the first and second diodes, and the output, the said total impedances being equal.

An embodiment of the present invention will now be described, by way of example, with reference to the accompanying drawings, in which.

Figure 1:
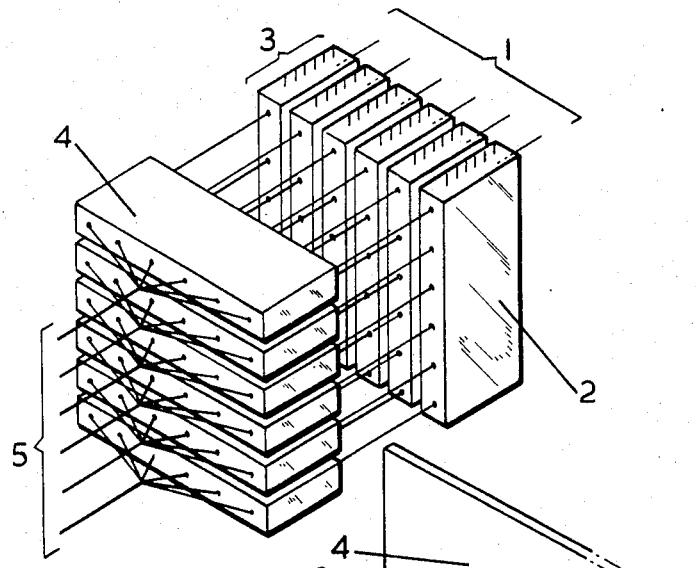
FIG. 1 is a schematic illustration of the structure of an embodiment of the invention for connecting any one of six inputs to any one of six outputs.

Referring to FIG. 1, six inputs 1 each carrying five frequency distinguished VHF signals are applied to respective input boards 2. Each input board supports six solid state switches (not shown) and a control circuit for selectively turning on any one of the six switches in response to signals applied to control inputs 3. Each of the switches on one input board is connected to a respective output board 4 which supports six further switches (not shown). Any one of the output board switches on any one board may be selectively switched on to connect the signal received from one input board to an output 5 common to the board 4.

The structure of FIG. 1 may be used to select any one of a series of packets of VHF signals received from the head end of a television distribution network and to pass the selected packet to a frequency selector whereby a single selected VHF signal can be converted to UHF and then transmitted to a subscriber to the network. The general structure of such a network may be appreciated by reference to the above mentioned British Patent Specifications.

Figure 2:
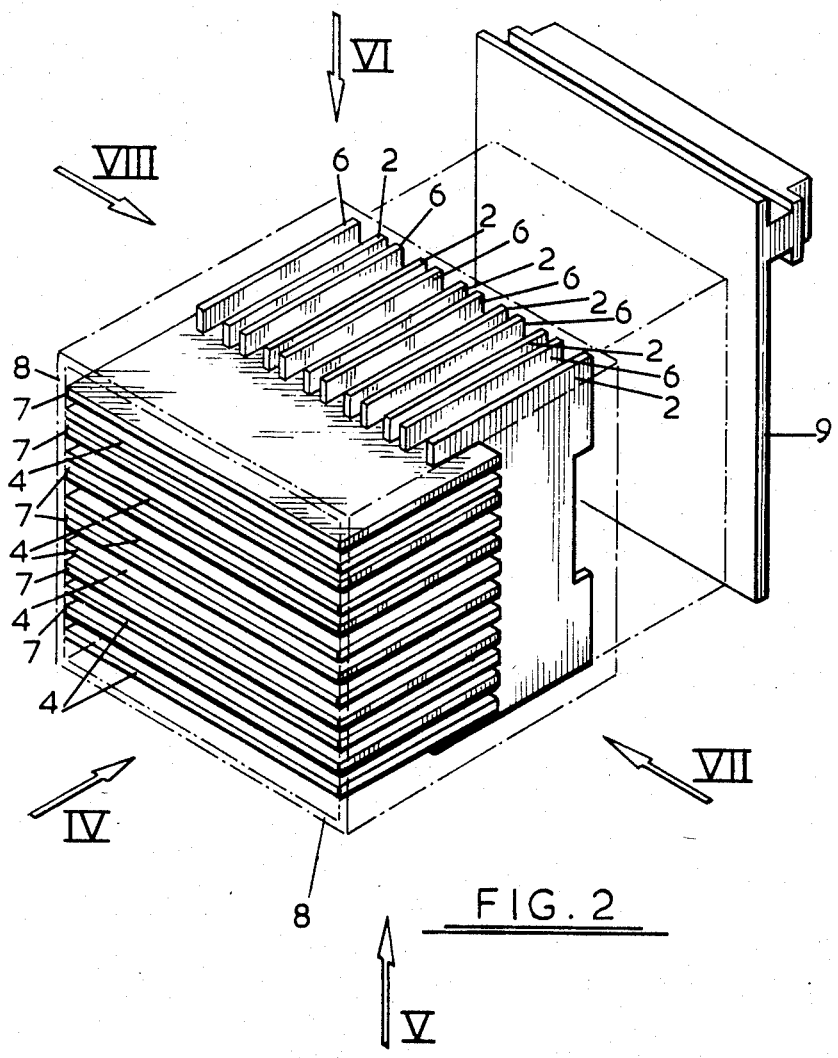
FIG. 2 is a simplified partially exploded view of a switch assembly housing the general structure of FIG. 1.

Referring to FIG. 2, the illustrated structure corresponds to the generalized structure of FIG. 1. Input boards 2 are interleaved with a first group of isolating plates 6 and output boards 4 are interleaved with a second group of isolating plates 7. An outer isolating screen 8 shown in broken lines is also provided. The assembly of boards and plates is mounted on a support board 9.

Figure 3:
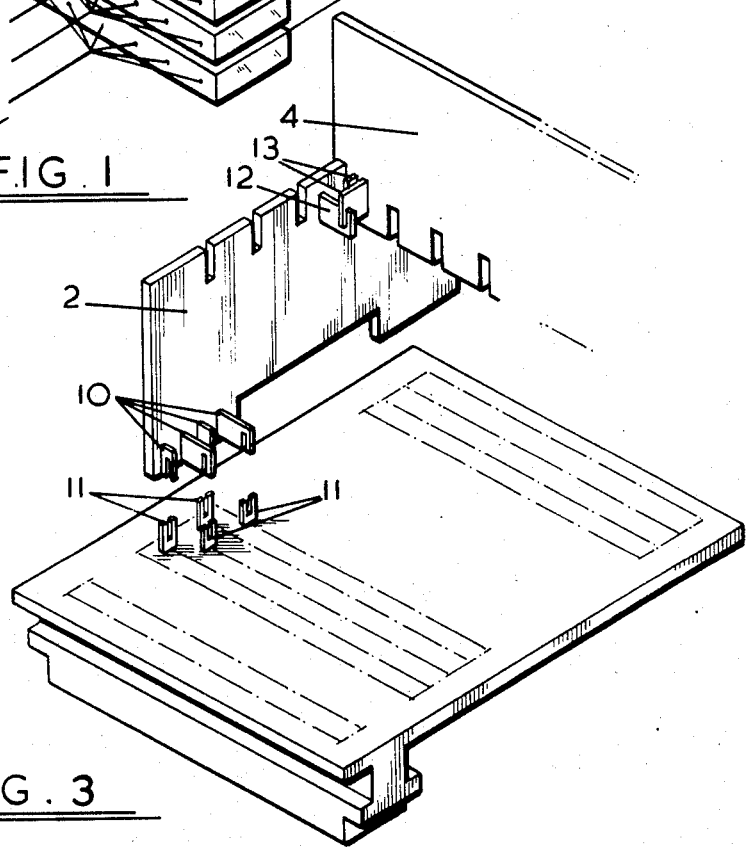
FIG. 3 illustrates the interconnection of components shown in FIG. 2.

Although not shown in FIG. 2, each input board 2 is connected by eight push in connectors to eight inputs on the support board. Thus each input board receives six DC switch control inputs, a DC supply voltage and a ground input. In addition, each output board is connected to each input board by two pairs of interengaging push terminals, one providing a signal path and the other ground. FIG. 3 shows the interengagement between the support board 9, the input board 2 furthest to the right in FIG. 2, and the fourth output board 4 counting from the top in FIG. 2. It will be seen that four terminals 10 at one end of the input board 2 make connections with four terminals 11 on the support board. A similar arrangement (not shown) is provided at the other end of the input board 2. In addition, two terminals 12 (only one of which is visible in FIG. 3) on the input board 2 engage two terminals 13 on the output board 4. Each input board has eight terminals 10 and six sets of terminals 12, and each output board has six sets of terminals 13. The assembled input and output boards thus define thirty six cross-point switches controlled by thirty six inputs 3 (FIG. 1).

Figure 4:
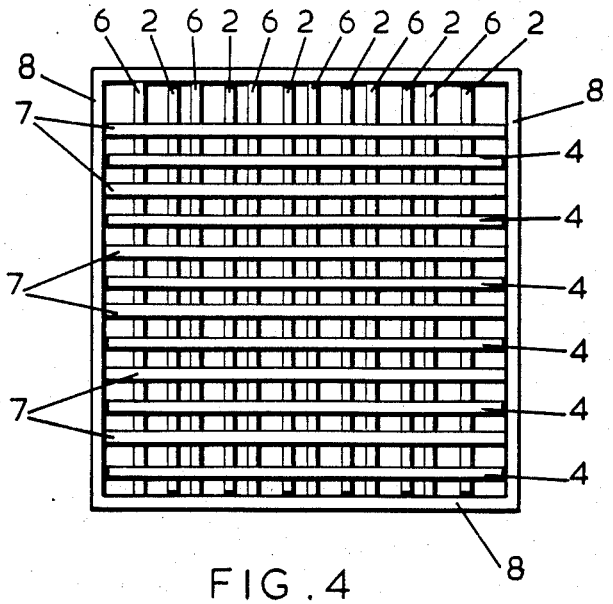
FIG. 4 is a view in the direction of arrow IV of the interleaved structure shown in FIG. 2.
Figure 5:
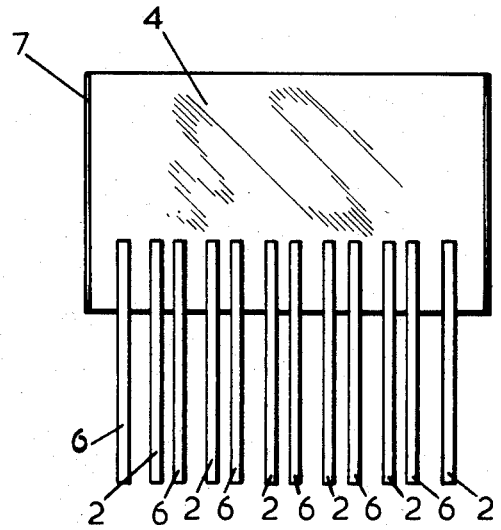
FIGS. 5 to 8 are respectively views in the direction of arrows V, VI, VII and VIII in FIG. 2, an outer screen shown in outline in FIG. 2 having been removed.

FIG. 4 is an end view in the direction of arrow IV of the assembly of boards and isolating plates. FIGS. 5 to 8 are respectively side views of the assembly in the directions of arrows V, VI, VII and VIII.

Figure 9:
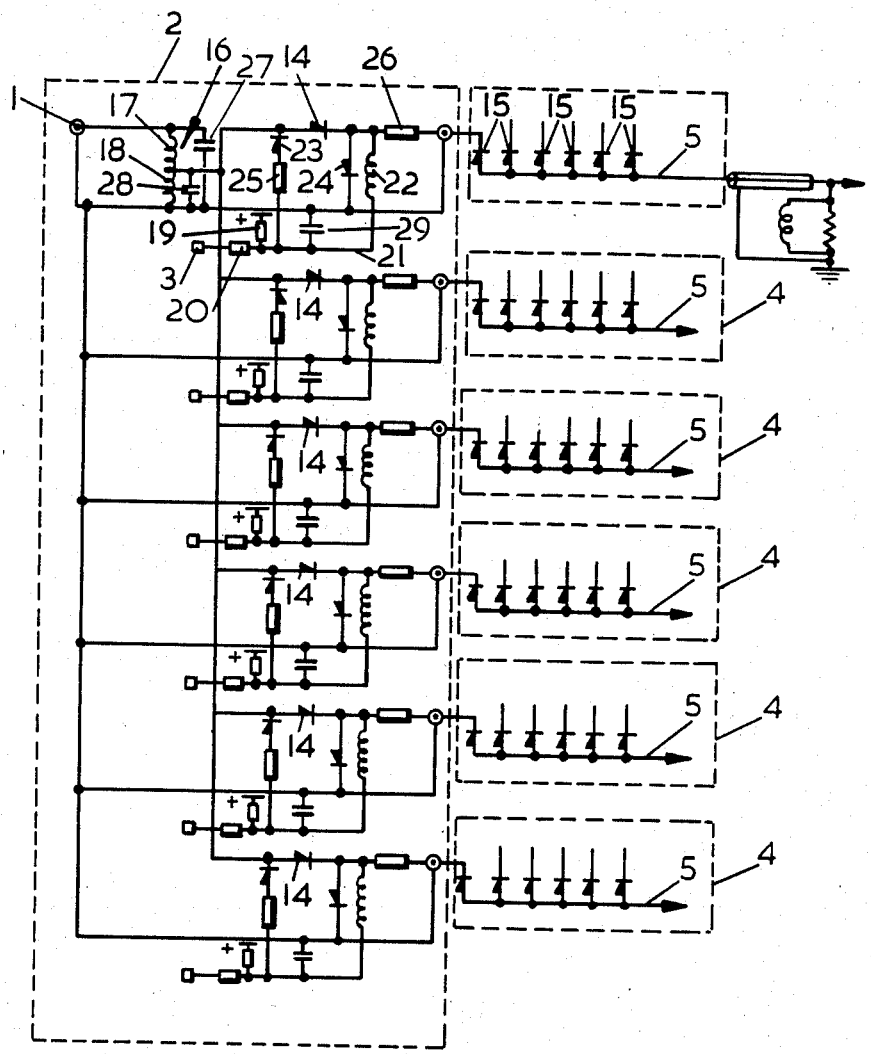
FIG. 9 is a diagram of part of the circuit supported by the structure of FIG. 2.

Referring now to FIG. 9, the electrical characteristics of the components not previously shown on the input and output boards are illustrated in a circuit diagram. Each input board 2 supports six switches in the form of diodes 14 which are controlled via inputs 3 by respective subscribers, and each output board 4 which serves a respective subscriber supports six switches in the form of diodes 15, each diode 15 being connected to a different input board 2. A packet of VHF signals appearing at input 1 (FIG. 1) is selected for transmission to individual subscribers outputs 5 by rendering the appropriate pair of diodes 14, 15 conductive. It may be that from none to all six of the subscribers fed from the six illustrated output boards 4 turns on the pairs of diodes 14, 15 simultaneously and it is therefore necessary to carefully match the switching circuits to maintain the desired impedances.

In one arrangement in which the illustrated circuit has given good results, the input and output lines 1 and 5 are both 50 ohm lines, and an input transformer 16 is formed by two ferrite cores having an upper section 17 with four turns and a lower section 18 having five turns. When the switch is "off", the control inputs 3 (FIG. 1) float up to the positive supply provided via resistors 19 and 20. When the switch is "on", a negative potential is applied to the input 3, pulling the voltage on line 21 negative.

When the switch is off, line 21 is positive, turning off the first diode 14 and the second diode 15 via a DC bypass choke 22. A third diode 23 and a fourth diode 24 are turned on via resistor 25 and choke 22 respectively. When the switch is on, line 21 is negative, turning on diodes 14 and 15 and turning off diodes 23 and 24. The output 5 is DC biased to ground via the load which includes a further DC bias choke connected in parallel with a 50 ohm resistor between the output line 5 and ground. The DC bias circuit is shown for only one of the outputs 5. The turns ratio of the transformer 16 gives it a 15 ohm approximately output. A series resistor 26 has an impedance of 39 ohms, and the resistor 25 has an impedance of 90 ohms. (In practice, a 91 ohm resistor would be selected as such resistors are commercially available, the one ohm difference having a negligible effect).

Looking from the transformer 16 towards the outputs, there are six impedances in parallel. When a switch is on, the impedance is 50 ohms (line 5) plus 2 ohms (diodes 14 and 15) plus 39 ohms (resistor 26) to give a total of 91 ohms. When a switch is off the impedance is 90 ohms (resistor 25) plus 1 ohm (diode 23) to give a total of 91 ohms. Thus the impedance is substantially the same no matter how many switches are on. Looking from the output 5, there are again six impedances in parallel. When a switch is off, the impedance is effectively infinite. When a switch is on, the impedance is 39 ohms (resistor 26), plus 2 ohms (diodes 14 and 15) to give a subtotal of 41 ohms plus five switches in parallel each of 91 ohms and the transformer 16. If the impedance of the parallel circuit is Z, then $1/Z=5/91+1/15$, which is approximately equal to 8.2 ohms. The total impedance is thus 49.2 ohms which represents a good match to the 50 ohm line 5.

Capacitors 27 (8.2 pF) and 28 (15 pF) deal with leakage inductance and capacitor 29 (1 nF) smooths the control current flowing through the control input 3.

Figure 10:
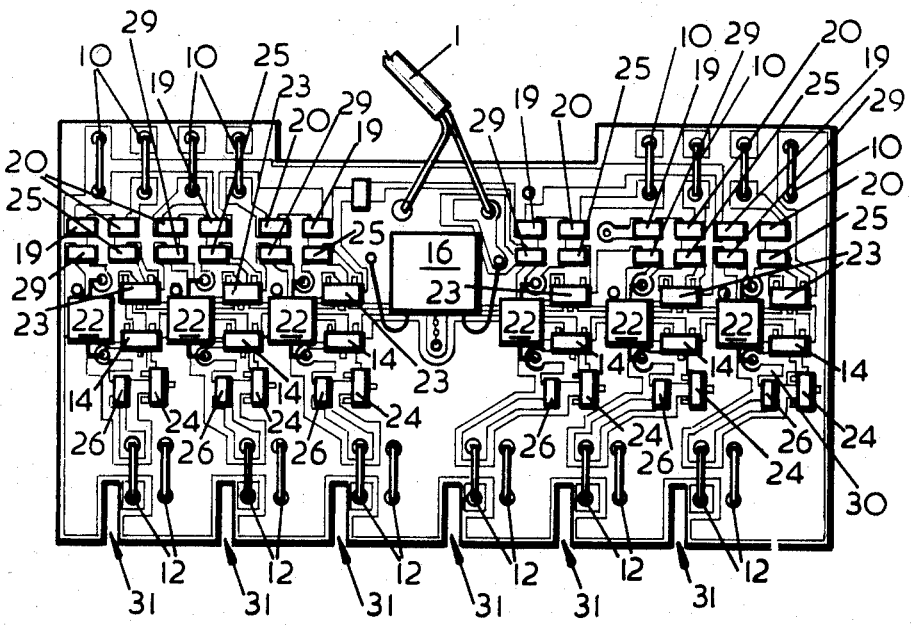
FIGS. 10 and 11 show the metalization patterns formed on and components secured to the two sides of the input board of the structure of FIG. 2.
Figure 11:
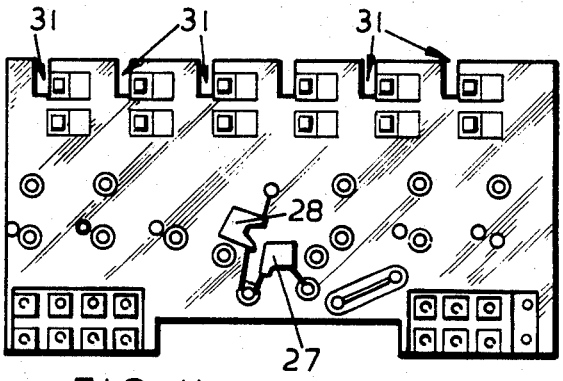

Referring now to FIGS. 10 and 11, the detailed structure of one input board 2 is illustrated. The components shown in FIG. 9 are indicated by the same reference numerals. The transformer 16 is a simple wire wound binocular ferrite core, and the chokes 22 are simple wire wound annular ferrite core. The other components are surface mounted chips. The metalized surfaces of the boards are carefully designed to minimize crosstalk. In particular there is a non-metalized portion 30 between the resistor 26 and the contact of the choke 22 to which it is connected. This is to ensure that signals on the metalized surface between the resistor 26 and choke 22 cannot bypass and thereby render ineffective the diode 24. Slots 31 are provided adjacent each of the terminals 12, these slots also being shown in FIG. 3.

Figure 12:
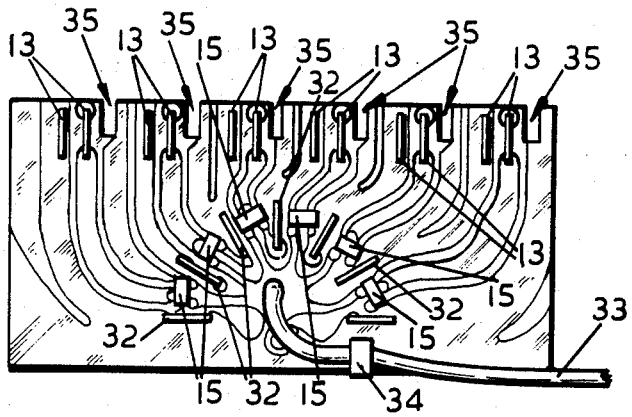
FIGS. 12 and 13 show the metalization patterns formed on and components secured to the two sides of the output board of the structure of FIG. 2.
Figure 13:
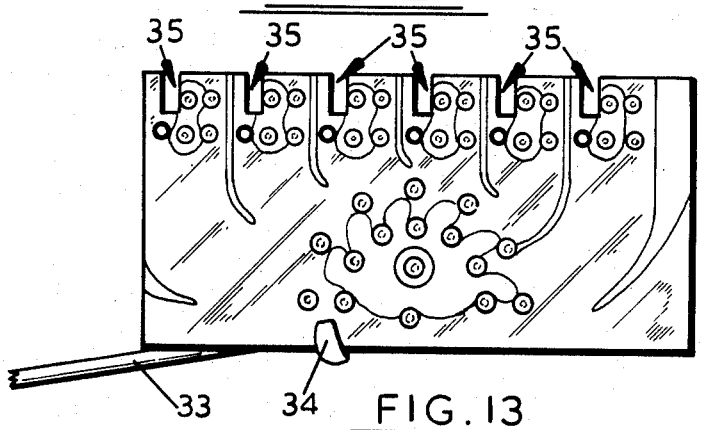

Referring now to FIGS. 12 and 13, the detailed structure of one output board 4 is illustrated. The diodes 15 are positioned between earthed rectangular plates 32 which prevent crosstalk between the one diode 15 which can be carrying signals at any particular time and the other conductive tracks. The selected signals are applied to a coaxial cable 33 which is secured to the board 4 by a clip 34. The board 4 is also provided with slots 35, and the slots 35 engage in the slots 31 of the input boards 2 when the boards are assembled together. Thus the edges of the input and output boards overlap by a distance equal to the sum of the depth of the slots 31 and 35.

Figure 6:
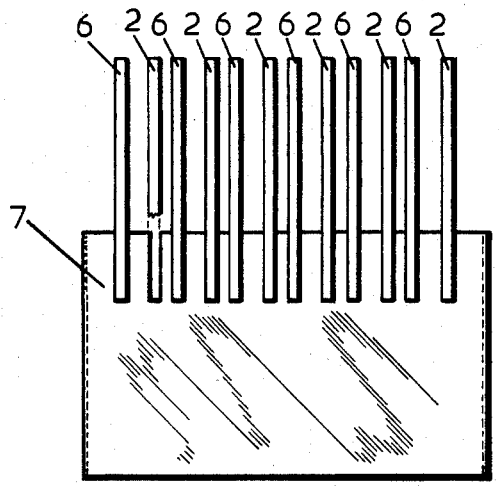
Figure 7:
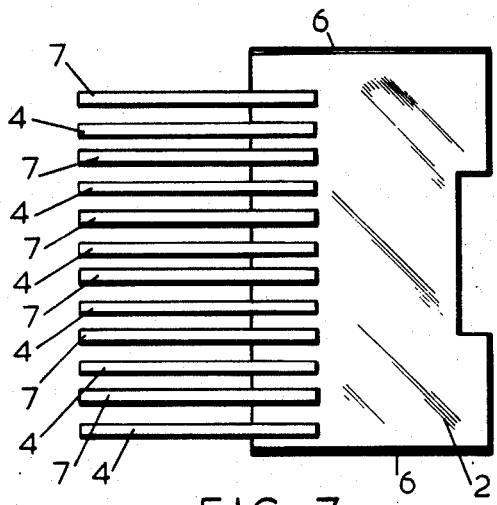
Figure 8:
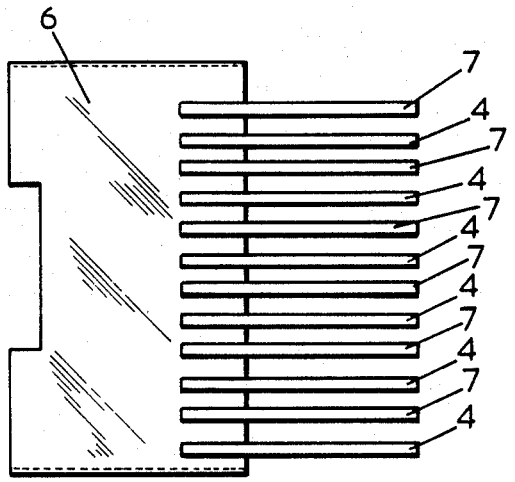

The edges of the isolating plates 6 and 7 are also slotted, as can be seen in the case of plate 7 from FIG. 6. The slots in the isolating plates receive the edges of the boards and are of twice the depth of the slots 31 and 35 in the boards. Thus each of the pairs of terminals 12, 13 (FIG. 3) is located within a four sided enclosure made up by elements of four isolating plates which extend into the spaces between the pairs of input and output boards. The signals appearing on any board are thus fully screened from every other board, and the terminals 12 and 13 are also fully screened. Appreciable crosstalk is thus effectively eliminated.

The described arrangement thus fully screens the various signal paths from each other and maintains good impedance matching regardless of which signal packet is selected by a subscriber.

The isolating plates 6 and 7 may be formed from individual plates suitably slotted to enable the structure illustrated to be assembled. The plates may be formed from tin plate hot dipped after assembly to form an integral assembly into which the input and output boards are inserted. Alternatively, the plates 6 and 7 may be formed in aluminium by extruding a single integral structure and then machining out those parts not required.

The preceding drawings illustrate an arrangement in which each screened switch unit comprises six input boards and six output boards. Any array of such switch units can be provided within a suitable housing to serve any number of subscribers. It is possible however to reduce the volume required by extending the input boards 2 to carry a plurality of the circuits shown in FIG. 9. For example, whereas the boards illustrated in FIGS. 10 to 13 are typically 58 mm in length, a double input board can be provided with a length of 146 mm, that is two end sections each identical to the input board of FIGS. 10 and 11, and a central section 30 mm in length. Such a double input board can be engaged by each of two sets of six output boards identical to that shown in FIGS. 12 and 13.

Figure 14:
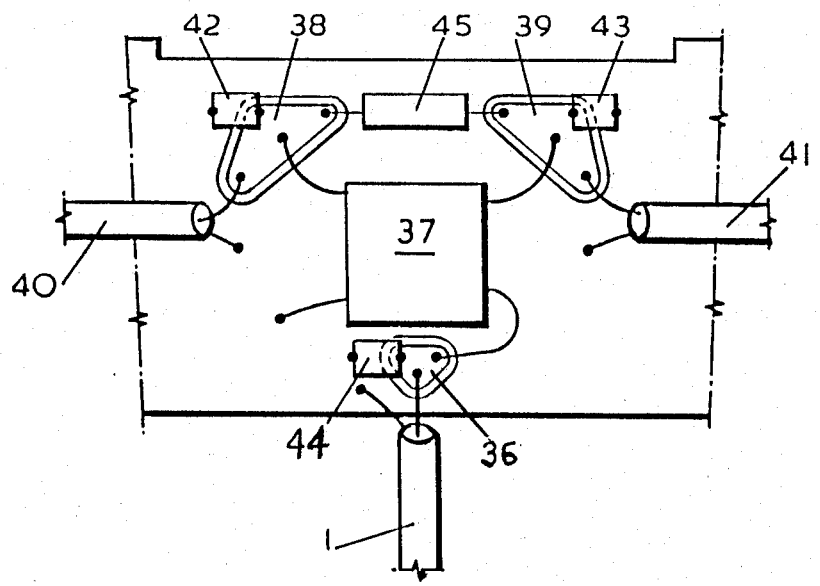
FIG. 14 illustrates the metalization pattern formed on and components supported by one side of an extended input board.
Figure 15:
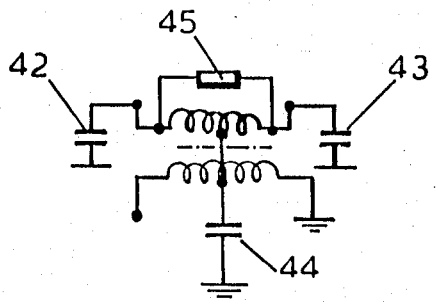
FIG. 15 is a diagram of the circuit supported by the portion of the extended input board of FIG. 14.

To avoid the need for two input cables to the input board, a 3 dB hybrid splitter may be mounted on the central section of the double board. The layout of such a splitter is shown in FIG. 14 and its electrical circuit is shown in FIG. 15. The structure and principle of operation of hybrid splitters is known from the prior art and further information in this regard can be obtained from our earlier British Patent Specification No. 1 317 244.

Referring to FIGS. 14 and 15, the input coaxial cable 1 is connected via a metalized pad 36 to an input winding of a transformer 37. Two output windings of the transformer are connected via metalized pads 38 and 39 to short coaxial cables 40 and 41 which are connected to the input transformers 16 of two circuits such as illustrated in FIG. 9. Capacitors 42, 43 and 44 and a resistor 45 are also provided. The capacitors 42, 43 and 44 compensate for leakage inductance.

The illustrated arrangement improves the response of the circuit at VHF frequencies while also resulting in a relatively fast fall-off in the circuit response at higher frequencies. This gives a better attenuation at UHF frequencies which is desirable given that the VHF signals passed by the switch are converted to UHF for transmission to a subscriber.

FIG. 11 shows the capacitors 27 and 28 mounted on the reverse side of the input board 2. In production versions of the input board the capacitors 27 and 28 will be mounted on the front surface of the board which surface is shown in FIG. 10, the capacitors being in the form of surface mounted components.

What is claimed is:

1. A switch assembly for connecting any one of a plurality of inputs each carrying a plurality of frequency distinguished signals to any one of a plurality of outputs, comprising an input board connected to each input and an output board connected to each output, the input boards being arranged in parallel and each supporting a solid state switch, each input board solid state switch being connected between the input to the board and a respective terminal located adjacent the board edge, the output boards being arranged in parallel so as to be substantially perpendicular to the input boards and each supporting a solid state switch, each output board solid state switch being connected between the output of the board and a respective terminal located adjacent the board edge, and each output board terminal engaging a respective input board terminal so that the terminals supported by any one output board engage terminals supported by respective ones of the input boards, wherein the adjacent pairs of parallel boards are isolated from each other by electrically conducting isolating plates interleaved with and extending parallel to the boards, the isolating plates comprising a first group located between the input boards and extending into the spaces between the output boards, and a second group located between the output boards and extending into the spaces between the input boards to form a series of four sided isolating structures within each of which the terminals of a respective pair of interengaging terminals are located and shielded to prevent crosstalk between the interengaged sets of terminals.

2. A switch assembly according to claim 1, wherein the said edges of the input and/or output boards are slotted so that the input and output boards interengage with the said edges overlapping.

3. A switch assembly according to claim 1, wherein the edges of the first and/or second group of isolating plates are slotted so that the boards engage in the slots with their edges overlapping the edges of the isolating plates.

4. A switch assembly according to claim 1, wherein the edges of the input and/or output boards are slotted so that the isolating plates engage in the slots with their edges overlapping the edges of the isolating plates.

5. A switch assembly according to claim 1, wherein the isolating plates define an integral structure formed by extrusion.

6. A switch assembly according to claim 1, wherein each input board switch comprises a first diode and each output board switch comprises a second diode, each first diode being connected to a respective second diode by a respective pair of interengaging terminals, and circuit means are provided to bias the first and second diodes on and off together.

7. A switch assembly according to claim 6, wherein the circuit means comprises a control circuit connected to each first diode mounted on the input board, the control circuit comprising a first resistor connected in series with the first and second diodes between an input transformer and the output a second resistor connected in series with a third diode between a control input and the input to the first diode, and a fourth diode connected between ground and a point between the first and second diodes.

8. A switch assembly according to claim 6, wherein grounded auxiliary isolating plates are mounted on the output boards between adjacent pairs of the second diodes.

9. A circuit for connecting an input carrying a plurality of frequency distinguished signals to an output, comprising a first input diode connected in series with a second output diode between a tapping of an input transformer and the output, the transformer winding being connected between the signal input and ground, a first resistor connected between and in series with the first and second diodes, a control input connected to the tapping of the input transformer by a second resistor in series with a third diode, a fourth diode connected between ground and a point between the first and second diodes, and means for controlling the polarity of the control input relative to ground, wherein the output has a DC bias to ground, and the polarities of the diodes are such that the application of a potential of one polarity to the control input causes the first and second diodes to turn on and the third and fourth diodes to turn off, and the application of a potential of the opposite polarity to the control input causes the first and second diodes to turn off and the third and fourth diodes to turn on, the total impedance presented to the tap by the switch when the switch is off being the sum of the impedances of the second resistor and the third diode, and the total impedance presented to the tap by the switch when the switch is on being the sum of the impedances of the first resistor, the first and second diodes, and the output, the said total impedances being equal.

* * * * *